United States Patent [19]

Svet

[11] 4,129,276

[45] Dec. 12, 1978

[54] TECHNIQUE FOR THE DETECTION OF FLAT WHEELS ON RAILROAD CARS BY ACOUSTICAL MEASURING MEANS

[75] Inventor: Frank A. Svet, Churchville, N.Y.

[73] Assignee: General Signal Corporation, Rochester, N.Y.

[21] Appl. No.: 873,566

[22] Filed: Jan. 30, 1978

[51] Int. Cl.[2] ..... B61L 1/06

[52] U.S. Cl. ..... 246/169 S; 246/DIG. 1; 340/38 S

[58] Field of Search ..... 246/169 R, 169 S, 169 D, 246/DIG. 1, 247; 340/38 S; 73/587, 598, 8, 146; 364/424

[56] References Cited

U.S. PATENT DOCUMENTS

| | | | |
|---|---|---|---|
| 3,016,457 | 1/1962 | Brown | 246/169 S |
| 3,844,513 | 10/1974 | Bernhardson | 246/169 R |
| 4,058,279 | 11/1977 | Frielinghaus | 246/169 R |

*Primary Examiner*—Trygve M. Blix
*Assistant Examiner*—Reinhard J. Eisenzopf
*Attorney, Agent, or Firm*—Milton E. Kleinman; John Ohlandt

[57] ABSTRACT

Method and apparatus for detecting the presence of flat wheels on railroad cars, comprising an electro-acoustic transducer located on the track wayside so as to pick up the vibrations generated by a passing train. If a flat wheel is present it will generate a periodic clanging sound at a frequency proportional to train speed and wheel diameter. The invention capitalizes particularly on the measurement of train speed to control the response of an adaptive filter so as to enhance the periodic clanging frequency with respect to the background noise, thereby to improve the signal-to-noise ratio; the enhanced signal is further autocorrelated for ten wheel revolutions and if a periodic signal is present in the narrow frequency band of interest, a large periodic autocorrelation output will result and, as a consequence, any wheel flat will be readily detected and will act to trigger an alarm to alert the train crew of the condition.

11 Claims, 7 Drawing Figures

DIGITAL FIRST ORDER ADAPTIVE FILTER

TECHNIQUE FOR THE DETECTION OF FLAT WHEELS ON RAILROAD CARS BY ACOUSTICAL MEASURING MEANS

BACKGROUND OF THE INVENTION

The present invention pertains to a detection method and apparatus and, more particularly, to a method and apparatus for detecting the presence of "flat" wheels, that is, wheels having flat segments, on railroad cars.

A so-called wheel flat results if a wheel of a railroad car or vehicle is so braked or locked that instead of rolling it slides along a rail. When this happens the high friction which develops between the wheel and the rail produces flat segments or portions in a given wheel. It will further be understood that the majority of these wheel flats appear during the winter because it is at this time that the brake shoes have a tendency to freeze against the wheels which results in the aforesaid sliding and the development of wheel flats. Other kinds of brake faults can also result in wheel flats, even during mild weather.

Accordingly, it will be appreciated that if wheel flats are left unattended or not repaired they can cause serious and extensive damage to rails as well as produce high stress regions on the wheel so that it becomes important to detect such flat wheels on railroad cars in order that the cars may be taken out of service so soon as practicable for repair.

It is, therefore, a fundamental object of the present invention to accomplish such detection efficiently and economically.

Certain kinds of apparatus have been directed to the detection of wheel flats and an example of an automatic means or apparatus for detecting their presence may be understood by reference to U.S. Pat. No. 3,844,513 in which there is disclosed a system and method for detecting the presence of wheel flats, such system relying on the sensing of changes in voltage resulting from a break in an established circuit caused by a wheel flat. Also, in the aforementioned patent, reference is made, in a general way, to a known acoustical method in which sound from a passing train is recorded and the particular sound cause by the impact between a wheel flat and the supporting rail is distinguished by detecting frequencies in that particular sound. Such an acoustical method is indicated in that patent as being an impractical solution, although the reason therefor is not given.

The present invention represents an improvement in an acoustical method of detecting flat wheels on railroad cars, it being a primary object of the invention to efficiently provide output signals indicative of the presence of flat wheels and to do so automatically and in conditions of poor signal-to-noise ratios. The inability previously to operate under such conditions is believed to be the major reason for the impracticability of prior art acoustical techniques for detecting wheel flats.

The present invention is based on the principle of effectively discriminating against the noise present in an acoustical signal that is picked up from the environment by adaptively filtering the acoustical signal so as to enhance significantly the signal-to-noise ratio, such adaptive filtering being made responsive to the particular wheel diameter and speed of the advancing railroad car or cars.

Accordingly, the present invention in its broadest terms resides in the provision of a system or method for acoustically detecting the presence of wheel flats, such system comprising an electro-acoustic transducer for picking up the sounds generated by a passing train; a demodulator or detector; a means for limiting the band width, for example, by a suitable external filter, so as to limit or restrict the band under consideration to that in which the normal periodic clanging sound of a wheel flat occurs; a sampling analog-to-digital converter operating at a frequency of approximately 200 Hz, in connection with a means for removing the DC or average value of the picked up signal; and a digital first order adaptive filter, connected to the analog-to-digital converter, and being provided with a filter adjusting input signal determined by the wheel diameter and the train speed, such that as a result the adaptive, or programmable, filter cuts off at a frequency which is approximately twice the frequency of interest, thereby allowing for some wheel size variation and train speed changes.

A primary feature, in addition to the above recited combination of elements, lies in the fact that an autocorrelator is utilized for performing autocorrelation with respect to predetermined signal samples received from the adaptive filter, such operation involving autocorrelating with respect to each of the predetermined signal samples and of the ten samples preceding each of the predetermined samples. More specifically, a current sampled and filtered signal value is obtained for every one-fifth of a wheel period; each sample value is stored in memory and is correlated with the aforenoted previously stored samples in memory.

Associated with the autocorrelator is a sampling gate which receives an input from a train wheel revolution period generator which provides a gating signal representative of one-fifth the period of the flat spot occurring on a train wheel. In other words, for any given train speed a gating signal is provided at every one-fifth of a wheel revolution. In accordance with the particular period of an occurring flat spot, the signal transmitted from the adaptive filter is gated through to the autocorrelator. The precise way in which this is effected will be described hereinafter.

A further feature resides in the provision of an interpolation means connected to the digital first order adaptive filter such that the 200 Hz sampler has the effect of a 2000 Hz sampler. Thus, the interpolation means permits implementation of the invention is a low cost, slow speed, signal processing system, which could take the form of a microprocessor currently on the market, some of which cost as little as twenty dollars in shipped form.

Other and further objects, advantages and features of the present invention will be understood by reference to the following specification in conjunction with the annexed drawing, wherein like parts have been given like numbers.

DESCRIPTION OF THE PREFERRED EMBODIMENT

Figure 1:
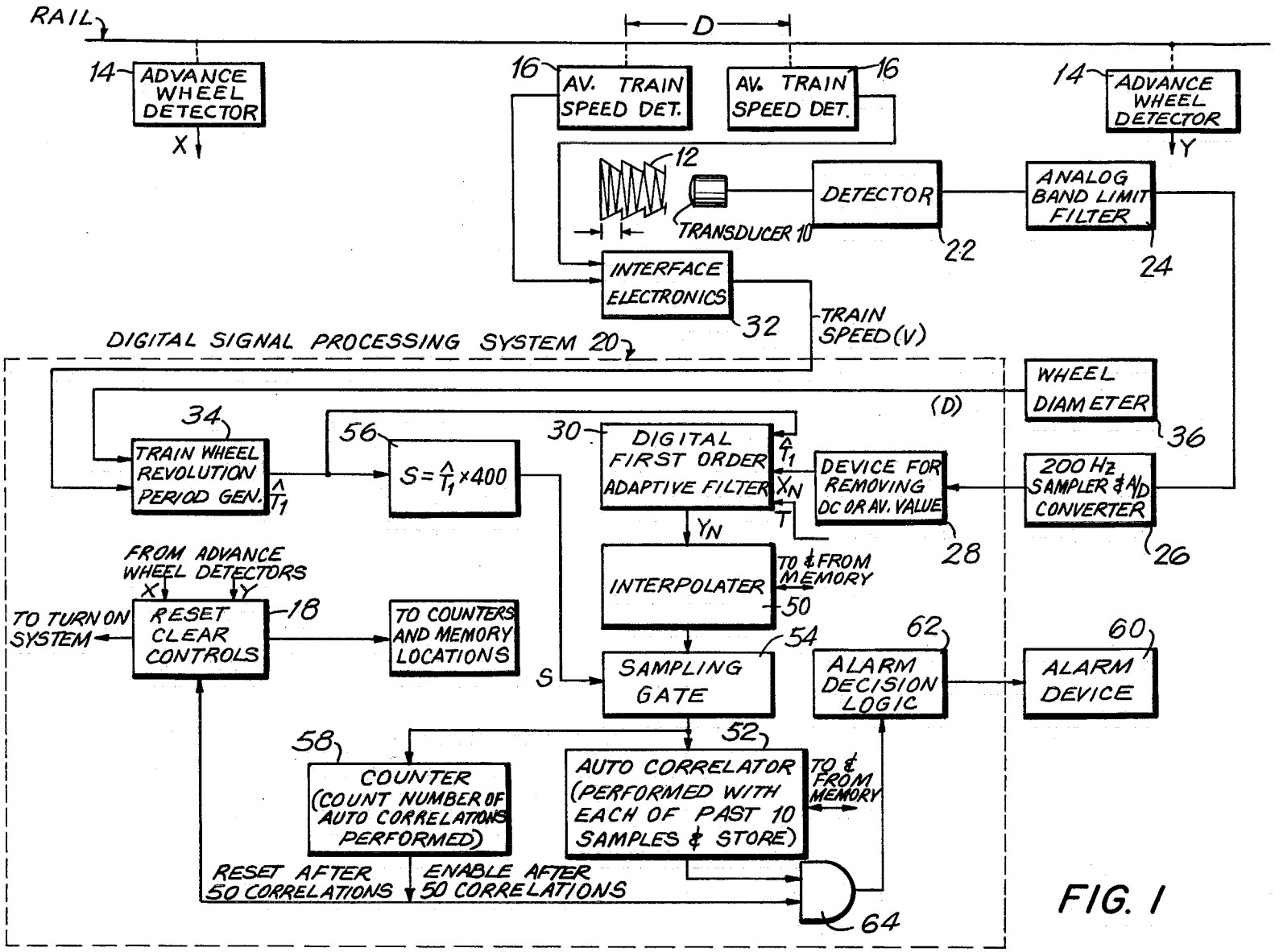
FIG. 1 is a block diagram representation of a system for acoustically detecting flat railroad car wheels in accordance with a preferred embodiment of the invention.

An over-all or top level view of a system in accordance with the present invention for acoustically detecting the presence of flat wheels on railroad cars may be seen in FIG. 1. An electroacoustic transducer 10, located on the wayside or on the rail illustrated, picks up sounds from the environment. A possible sound wave form 12 is shown adjacent the transducer 10, such wave form including the periodic clanging sound of a wheel having a flat spot.

Pairs of detectors 14 and 16 function to sense the presence and speed of a train. The two "outer" detectors, that is, the advance wheel detectors 14, operate by means of simple switching devices to provide output signals X and Y, which, as will be seen in FIG. 1, serve as inputs to a reset and clear controls device 18 which operates to turn on the digital signal processing system 20, including the function of unsquelching the transducer 10, when a train approaches from either direction.

It will be appreciated that the "inner" wheel detectors 16 are located a fixed distance D apart; therefore, the time it takes a particular wheel to pass over the fixed distance is a measure of the average train speed at that instant and time. Of course, train speed could be measured in other ways such as for example, by means of Doppler radar. The electric signals from the transducer 10 are amplified and fed to an analog detector-filter network comprising detector 22 and analog band limit filter 24. This network serves to demodulate the signal as well as to band limit to those frequencies below 63 Hz before the signal is to be sampled.

The above noted aspect of the present invention is based on the assumption that there will usually be only one flat spot on any given sheel. The frequency with which this flat spot produces the characteristic thump or clang on the rail is a function of both wheel diameter and train speed, and this frequency is calculated simply from the following equation: Frequency of flat spot clang equals train speed in feet per second divided by wheel circumference in feet or $F = V/2\pi r = V/\pi D$. The period or inverse of this frequency is $\hat{T}_1 = \pi D/V = 1/F_{flat}$.

It will be apparent that the highest flat spot frequency occurs with the smallest wheel diameter and with the highest train speed, while the lowest frequency occurs at the lowest train speed and largest wheel diameter. These frequency limits typically would be 0.77 clangs per second for 5 mph traffic and 36 in. wheels to 19.7 clangs/sec at 95 mph with 27 inch wheels. It can thus be clearly seen that the selection of 63 Hz for the cutoff frequency of filter 24 enables the passing of at least the fundamental and the second harmonic of the flat spot frequency.

The demodulated band limited signal from the output of filter 24 is passed to a 200 Hz sampling A/D converter 26. Such a device 26 is well known to those skilled in the art and can be appreciated in detail by reference to manufacturer catalogs such as DATEL SYSTEMS INC. or BURR BROWN, the details thereof being incorporated herein by reference. The point in using a relatively low frequency of 200 Hz is to provide economically for the sampling and digital signal processing of the sound spectrum.

The signals representing the digital sampling of the band limited sound spectrum as these emerge from the output of the sampling A/D converter 26 are intended to be digitally filtered by an adaptive, or programmable, first order digital filter 30. However, before the signals are received by filter 30, a device 28 for removing DC or average values is utilized at the output of converter 26. This device 28 is well known and typically can comprise an adder, which will serve the function of adding up all of the incoming digital samples such as, for example, a number of samples like 50; a divider-subtracter will take the average of these 50 samples and then will subtract the average value from each of the individual samples, thereby indicating how far each individual sample is varying above or below the average.

The latter two devices 28 and 30 form part of the digital signal processing system 20, which for purposes of illustration is shown in discrete form; however, it will be appreciated that this system can be entirely implemented by a well known microprocessor of standard construction; such as, for example, the processor 8080 manufactured by Intel Corp.

The adaptive filter 30 has a cutoff frequency which is made a function of train speed. In order to realize this function, the train speed information, as derived from the aforenoted measurement obtained by the average train speed detectors 16, is transmitted through interface electronics 32, the output of which is taken to the input of period generator 34. This generator develops an output signal which is fed to one of the inputs connected to the adaptive filter 30; that is, the input designated $\hat{T}_1$. This signal is developed in accordance with the previously noted formula, that is, $\hat{T}_1 = \pi D/\text{Velocity}$. It will also be seen that the wheel diameter information is fed to the period generator from the block designated 36. Accordingly, the signal $\hat{T}_1$ that is fed to the adaptive filter 30 is determined by these two parameters of interest, that is, train speed and wheel diameter.

It should be noted that the development of the filter's cutoff frequency as a function of train speed acts to improve the signal-to-noise ratio of the processed signal by eliminating those frequency components that lie outside of the band in interest, (recalling that the frequency of interest is the clang frequency of the flat wheel). The adaptive filter 30 specifically modifies (filters) the input digital sound spectrum in accordance with the following:

$$Y_n = (e^{-T/\tau})Y_{n-1} + (1 - e^{-T/\tau})X_n$$

At each of the samples, $X_n$, from the A/D converter 26 (where $T = 0.005$ seconds, which is the period between A/D converter output samples) a new filtered output, $Y_n$, is produced by adding a percent of the input $X_n$ to a percent of the last produced filter output, $Y_n - 1$. Thus, by adjusting the percents of new (input) to old (previous filter output) we change the filter's cutoff characteristic. The filter's cutoff is related to the average train speed through $\tau$, where $\tau$ is selected as $= 1/(2\pi F_{flat})$ (2). Thus, for example, if a train with a 36 in. diameter wheels is travelling at 22.77 mph or 33.47 ft./sec., then the flat spot frequency is 3.55 Hz. The programmable filter would then cut off at approximately 7.10 Hz; that is, at twice the frequency of interest ($F_{flat}$) so as to allow for wheel size variation and train speed changes.

Under the assumption of the above-noted values, where $T = 0.005$ and $\tau$ for the example $= 0.0224$, it turns out that $e^{-T/\tau}$ would be equal to 0.8. Accordingly, a typical sequence of values for $Y_n$ and $Y_{n-1}$ would be as indicated below:

| N | $Y_{n-1}$ | $X_n$ | $Y_n$ |
|---|---|---|---|
| 1 | 0 | 1 | .20 |
| 2 | .2 | 1 | .36 |
| 3 | .36 | 1 | .488 |
| 4 | .488 | 1 | .5904 |
| 5 | .5904 | 1 | .672 |
| 6 | .672 | 1 | .7376 |

Figure 2:
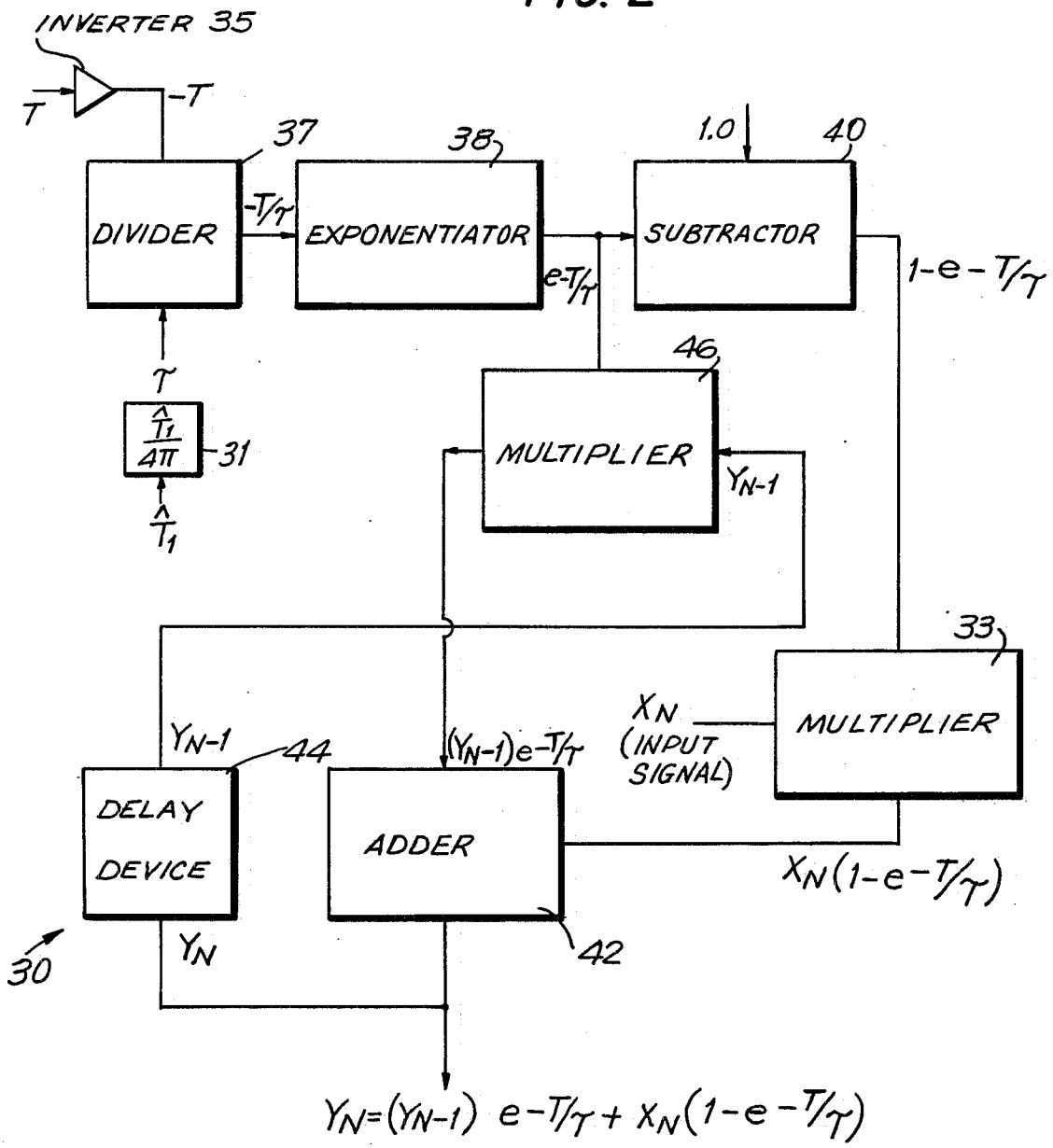
FIG. 2 is a block diagram representation of an adaptive filter incorporated as part of the system of the invention.

Turning now to FIG. 2, a detailed block representation of the adaptive filter 30 is shown. This constitutes a hardware implementation of such adaptive filter. However, as has already been indicated, since the digital signal processing system 20 can be constituted by a microprocessor, the adapter filter 30 could instead be implemented by means of software, which is a well known advantage of a microprocessor. However, for illustrative purposes the block representation of FIG. 2 is provided. In this arrangement, standard logic blocks in the form of integrated circuit chips would be appropriately connected. Such integrated circuit chips are readily available and can be purchased from well known manufacturers such as Texas Instruments, Dallas, Texas.

Accordingly, in FIG. 2 the input signal $X_n$ is applied to the input of a multiplier 33 such that this first input signal can be multiplied with the term $(1-e^{-T/\tau})$, the latter being developed from the upper portion of the circuit in which the value of T and $\tau$ are first applied to suitable devices. Thus, the time period for the sampling converter ($T = 0.005$ sec.) is applied to an inverter device 35 (upper left) so as to derive $-T$ at the output thereof. The output $-T/\tau$ is derived by the operation of the divider 37, and it will be appreciated that the desired term is further developed by means of exponentiator 38 and subtractor 40 to provide the signal $(1-e^{T/\tau})$ at the second input of the multiplier 33. A further divider 31, connected to an input of divider 37, functions to convert the signal value $\hat{T}$ to $\tau$ by dividing $\hat{T}$ by $4\pi$.

The output of multiplier 33, that is, $X_n(1-e^{-T/\tau})$, is fed to an input of adder 42. The sum desired, that is, $Y_n-1\ (e^{-T/\tau} + X_n(1-e^{-T/\tau})$, is accordingly derived at the output of the adder 42. The second input to this adder is, of course, derived from multiplying the previous value $Y_n-1$, which has been suitably delayed 0.005 sec. (which is one sample period) by delay device 44, with $-T/\tau$, the latter term having been derived at the output of exponentiator 38 and brought to the other input of multiplier 46.

In order to provide the equivalent of a 2000 Hz sample rate from the 200 Hz sampling analog-to-digital converter, linear interpolation is performed on each of the sample outputs $Y_n$ from the adaptive filter 30. Thus, the output is subdivided in accordance with a straight line formulation, $Y = mx+b$. This requires that each of the values be suitably stored in an ancillary memory associated with an interpolator 50. Accordingly, taking a typical example noted in the table above of successive values of 0 and 0.20 for $Y_n$, ten interpolated values of 0.02, 0.04, etc. are developed by the linear interpolator. This can be readily accomplished because there is plenty of time, between the detection of a first value for $Y_n$ and the next succeeding value, to develop the subdivided values, since the sampling period is 0.005 seconds and integrated circuits are capable of operating at submicrosecond speeds.

Before the output signals from interpolator 50 can be fed to an autocorrelator 52, they must be processed by means of a sampling gate 54 which is also provided with an input from the block $S = \hat{T}_1 \times 400$, such block being designated 56. The reason the train wheel revolution period generator value, that is, $\hat{T}_1$, is multiplied by 400 is that it is necessary to apply a constant, that is, a scalar factor which enables one to obtain integers which are adequate in the light of the possibly high train speeds that may be involved, and integers that are consistent with the subdivided $Y_n$ samples; remembering that we now have generated ten approximate data values for each $Y_n$ by subdividing the interval by ten. In other words, with train speeds approximating 20 miles per hour the wheel revolution periods would be very low, of the order of 0.050, which would be so small that errors in counting would be much too high, for example, about 5%. By multiplying by the constant 400, the count becomes so high that any error is substantially reduced.

It will be appreciated that the sampling gate 54 is so arranged that whenever a sample S has occurred the output from the interpolator is fed to autocorrelator 52. Thus the sample S functions as a control on the gate 54 to gate through the necessary interpolated values.

It should noted that the autocorrelator 52 is a device well-known in the art and could, for example, be one produced by the Federal Scientific Corporation called the "Ubiquitous Correlator" (UC-201). The algorithm for such an autocorrelator is designed so that autocorrelation of the sampled-filtered input signal occurs five times per wheel revolution. It is likely that the correlator algorithm will require an "input" in time that falls between two samples from the sampling A to D converter 26, since the correlator requires an input at one-fifth the wheel flat period, that is, $\hat{T}_1$. The ten interpolated points already described between each of the 200 Hz samples provides this "input". As an illustrative example, if a thirty mile per hour train with 36 inch wheels rolls by, the period of a wheel revolution is approximately 214 milliseconds. If five correlations in time are performed per wheel revolution or, in other words, five pieces of data for each wheel revolution, this means that a sampled input is required from the transducer every 42.8 milliseconds. However, the sample rate already selected is one sample per 5 milliseconds ($T = 0.005$). Thus with no interpolation the input signals would ordinarily occur quantized in time at 40, 85, 125, 170, 210 milliseconds instead of 42.8, 85.6, 128.4, 171.2, 214 milliseconds. It will thus be understood that interpolation gives us a reasonable "estimate" at 42.5 milliseconds, 85.5 milliseconds, 128 and 171. Although interpolation is not as good as having an actual 2000 Hz or higher frequency A/D converter, yet it permits implementation in low cost, slow spaced microprocessor or equivalent logic system, affording surprisingly good results even though only a 200 Hz A/D converter is utilized. Accordingly, the microprocessor does not have to input at 2000 Hz but instead at 200 Hz.

As has already been noted, the present invention is so designed that it requires that five autocorrelations be performed per wheel revolution. Moreover, judgment is reserved about a particular incident involving the passage of a train until ten wheel revolutions have been analyzed. This means that every one-fifth of a wheel period there is obtained the most current sampled-filtered signal value (or an interpolation between two of those values). This value is stored in memory and is autocorrelated with previously stored samples in memory.

The block 56 in FIG. 1 which performs the "S" calculation tells the system how many 200 Hz samples and interpolated subsamples to look for before storing one for the autocorrelation operation. Since the interpolation process is an approximation to 2000 Hz sampling, S is really the number of 2000 Hz samples that occur in one-fifth of a wheel revolution. Accordingly, it serves as an upper limit on a resettable pulse counter forming part of block 56.

It will be seen that the reset and clear controls 18 operate responsive to a counter 58 so that resetting of memory and counters occurs after fifty autocorrelations. However, the present invention could be implemented using a running average correlation that correlates in a new signal while dropping the oldest correlation from the correlation total. Once a sample has been selected for storage, the autocorrelator device 52 autocorrelates that particular sample with itself and each of the last ten previously stored samples; it then stores the eleven autocorrelation results to date, and shifts the input sample in time while discarding the oldest, that is, the tenth previous, sample from memory.

The operation of digital autocorrelation performed by device 52 is carried out with the following algorithm for N from 1 to 50:

$$A_n = \frac{A_n - 1 + (S_n)(S_n - x)}{N}$$

Where $A_n$ = nth correlation result

N = Number of correlations $S_n$ = nth input signal value $S_n - x$ = N−x previous input signal value where x is a preselected constant from 0 to 10

There are eleven of these such equation operations being performed each time an autocorrelation is performed.

It will thus be appreciated that eleven autocorrelations are performed for each new input signal value. The input signal is autocorrelated with itself, the last input, the one before, and the one before that and so on, up to the tenth prior input. Thus at any one time there are eleven different "$A_n$" results in eleven memory locations each representing the correlation of a signal with itself shifted in time by a multiple of one-fifth of a flat wheel period. It should be recalled again that a flat wheel period is proportional to train speed and to wheel diameter.

Figures 3A, 3B, 3C, 3D:
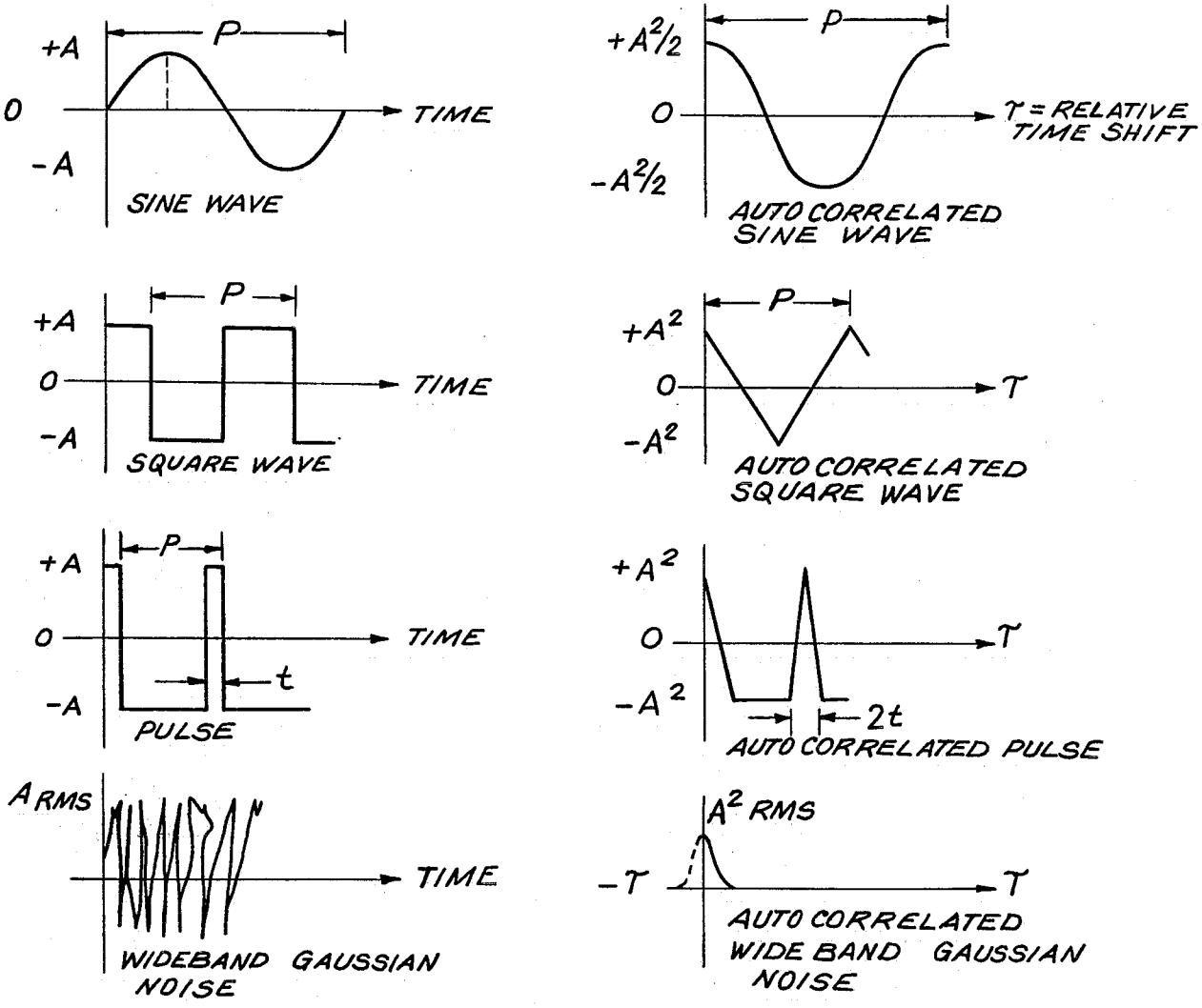
FIG. 3 is an illustration of typical autocorrelations of real time functions which are associated with or involved in the preferred embodiment.
Figure 4:
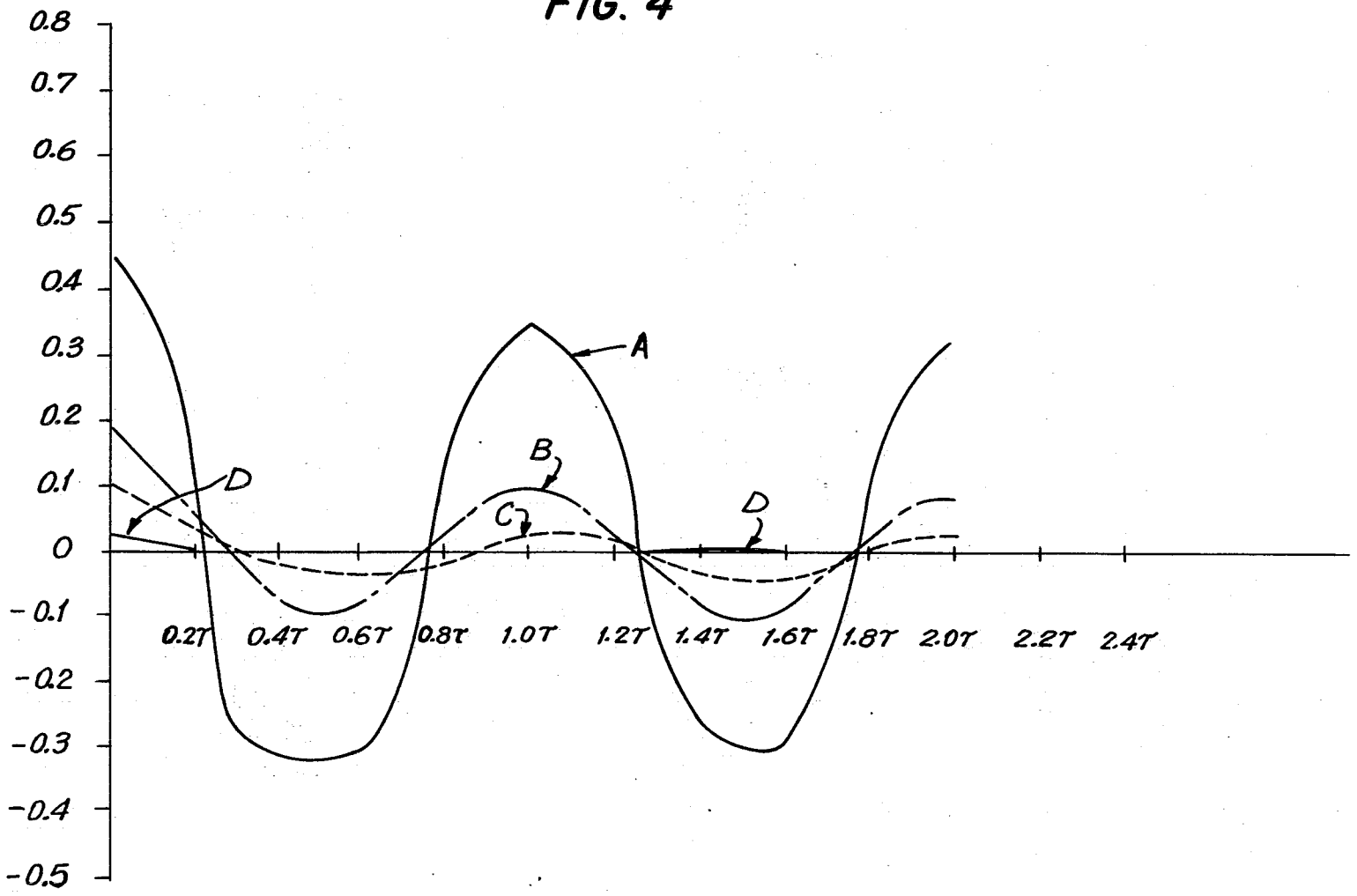
FIG. 4 illustrates a number of wave forms resulting from the autocorrelation of a sinusoid with varying random noise present in the original signal.

In operation, if the acoustic signal picked up by transducer 10 is of such character that the clanging sound resulting from a flat spot is present there will be generated an electrical signal responsive to this clanging sound which after processing, that is, filtering and autocorrelating, will produce an autocorrelated output sequence as shown in FIG. 3 for the given wave form shown. A variety of different waveforms are depicted in FIGS. 3A, 3B, 3C, and 3D. The respective autocorrelated outputs are shown to the right of the predetermined functions such as sine wave, square wave, spiked pulse wave and pure noise wave. By dint of autocorrelation very significant outputs have occurred in cases where signal-to-background noise ratios were as poor as 0.5 to 1.0 as is shown in FIG. 4. Thus it will be understood that, in autocorrelating a function which includes random noise, the noise tends to cancel out in the autocorrelating process leaving only a periodic flat spot input signal, if any. Wide band gaussian noise has the autocorrelation shown in FIG. 3D.

Referring to FIG. 4, a number of autocorrelations of a variety of sinusoids (whose frequency is a function of train wheel diameter), with a DC offset of 4.0 units, such as volts, is plotted with respect to $\tau$, which is the amount of shift in the autocorrelator, where $\tau$ is the period corresponding to a 32 inch average size wheel, and where the speed is 15 miles per hour. In addition, 60 Hz random noise has been added to the signal and the external filter cutoff frequency is 40 Hz, that is, the cutoff frequency of filter 24.

It will be noted, first of all with respect to FIG. 4, that with only random noise present virtually no signal output results from the autocorrelator. See waveform D in FIG. 4. However, in the other three instances, i.e., of waveforms A, B and C, very significant outputs result. In the case of waveform A, the signal-to-noise ratio has been arranged to be 1:1 (mean signal plus noise equals 4.037, standard deviation equals 0,9036). In the case of the B waveform, the signal-to- noise ratio is 0.5 (mean signal plus noise: 2.03979, standard deviation: 0.6945). In the last case, that is, the C waveform has a signal-to-noise ratio of 0.25 (mean signal plus noise: 0.9587, standard deviation: 0.6059).

Referring back to FIG. 1, it will be understood that an alarm device 60 is actuated in the event that an appropriate signal is received from the alarm decision logic 62 which action is in response to the signals from AND gate 64, which provides an output only when the gate has been enabled as a result of fifty correlations being performed (5 autocorrelations per wheel revolution times 10 wheel revolutions).

It will thus be understood that the logic device 62 is designed to examine 10 wheel revolutions regardless of train speed before resetting and examining ten new wheel revolutions. Also, since the transducer 10 does not key on a specific wheel but instead on groups of wheels, the system is actually listening to a wheel group over a constant distance range of about 70 to 100 feet which is on the order of one to two box car lengths.

What has been disclosed is a method and a system for detecting the presence of flat wheels on railroad cars by acoustical measuring means, such system particularly including an adaptive filter means which responds to a primary variable such as train speed so as to enhance the periodic clanging frequency of the wheel flat, thereby to improve the signal-to-noise ratio and to enable ready detection of the presence of such wheel flats. Furthermore, the system includes unique interpolating means combined with autocorrelation means so as to permit the utilization of a relatively slow sampling analog-to-digital converter thereby making the system a low cost system.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. Apparatus for acoustically detecting the presence of flat wheels on railroad cars, comprising an electro-acoustic transducer located on the track wayside so as to pick up vibrations generated by a passing train, and to provide a spectrum of electrical signals corresponding to the vibrations;

means for demodulating and band limiting said spectrum of electrical signals from said transducer;

a sampling analog-to-digital converter connected to said first named means so as to sample signals from the first named means at a predetermined frequency or period;

means for providing a signal indicative of train speed;

a digital first order adaptive filter for receiving sample signals from said converter and a signal from said means for providing a signal indicative of train speed, said adaptive filter having a cutoff frequency which is a function of train speed so as to enhance the signal-to-noise ratio of the signals processed thereby;

an autocorrelator for receiving signals from said adaptive filter and for performing autocorrelation with respect to each of the predetermined signal samples and of the ten signal samples preceding each of the predetermined samples;

a sampling gate, including means for permitting signals from said adaptive filter to be transmitted to said autocorrelator is dependence on the train speed.

2. Apparatus as defined in claim 1, in which the sampling frequency of said analog-to-digital converter is approximately 200 Hz.

3. Apparatus as defined in claim 2, in which interpolating means are associated with said 200 Hz analog-to-digital converter such that the output from said digital adaptive filter is subdivided between regular successive outputs, each of said successive outputs occurring every 0.005 seconds, the subdivision comprising ten interpolated values by linear interpolation whereby a 2000 Hz sample rate for said converter is approximated.

4. Apparatus as defined in claim 1, in which said sampling analog-to-digital converter provides an input digital sound spectrum corresponding to said spectrum of electrical signals from said transducer, and in which said adaptive filter modifies said input digital sound spectrum in accordance with: $Y_n = (e^{-T/\tau})Y_{n-1} + (1 - e^{-T/\tau})X_n$, where $Y_n$ represents a new filtered output, $X_n$ is the input to the filter, $Y_{n-1}$ is the previously produced filter output, T is the period between output samples from the A to D converter, and $\tau$ is equal to $1/(2\pi F_{flat})$ (2), where $F_{flat}$ is the flat spot frequency of interest.

5. Apparatus as defined in claim 1, in which said converter produces sample signals having an average value and in which means for removing the average value from the sample signals transmitted by the converter is connected to the input of said adaptive filter.

6. Apparatus as defined in claim 1, in which a first counter, connected to the output of said sampling gate, is provided for counting 50 autocorrelation steps.

7. Apparatus as defined in claim 6, further comprising a logical AND gate having at least two inputs, a plurality of additional counters and memories, control means for resetting and clearing said additional counters and memories, said first counter being connected to said control means and to one of said inputs of said logical AND gate, the other input of said logical AND gate being connected to said autocorrelator whereby an output is provided from said logical AND gate only when the gate has been enabled as a result of 50 autocorrelations having been performed and the detected signal indicates that a flat spot has occurred.

8. Apparatus as defined in claim 7, in which an alarm decision logic means is connected to the output of said logical AND gate.

9. Apparatus as defined in claim 8, in which an alarm mechanism is connected to said alarm decision logic means for indicating that a wheel flat has been detected.

10. Apparatus as defined in claim 1, further comprising a train wheel revolution period generator for providing a signal representative of the period of the flat spot on said wheel, said period generator being connected to said digital first order adaptive filter so as to control the response of the adaptive filter and thereby enhance the periodic clanging frequency with respect to background noise.

11. Apparatus as defined in claim 10, further comprising means for multiplying said period signal by a constant such that a large value is obtainable, and means for connecting the output thereof to said sampling gate such that five signal samples are fed to said autocorrelator for each wheel flat period detected, means for connecting said period generator to said adaptive filter and to said means for multiplying.

* * * * *